US010304383B2

(12) United States Patent
Kubota et al.

(10) Patent No.: US 10,304,383 B2
(45) Date of Patent: May 28, 2019

(54) DISPLAY APPARATUS

(71) Applicant: Japan Display Inc., Tokyo (JP)

(72) Inventors: Masahiro Kubota, Tokyo (JP); Norio Nakamura, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 15/724,383

(22) Filed: Oct. 4, 2017

(65) Prior Publication Data

US 2018/0102092 A1 Apr. 12, 2018

(30) Foreign Application Priority Data

Oct. 7, 2016 (JP) ..... 2016-198798

(51) Int. Cl.

| | |
|---|---|
| ***G09G 5/10*** | (2006.01) |
| ***G09G 3/3233*** | (2016.01) |
| ***G09G 3/20*** | (2006.01) |
| *G09G 3/3266* | (2016.01) |
| *G09G 3/325* | (2016.01) |

(52) U.S. Cl.

CPC ..... *G09G 3/3233* (2013.01); *G09G 3/2003* (2013.01); *G09G 3/2081* (2013.01); *G09G 3/325* (2013.01); *G09G 3/3266* (2013.01); *G09G 2310/08* (2013.01); *G09G 2320/0233* (2013.01); *G09G 2320/0247* (2013.01); *G09G 2320/064* (2013.01); *G09G 2330/02* (2013.01)

(58) Field of Classification Search

CPC ..... G09G 3/2033; G09G 3/288; G09G 3/2037
USPC ..... 345/63, 690
See application file for complete search history.

(56) References Cited

U.S. PATENT DOCUMENTS

2004/0164934 A1 8/2004 Jeong
2010/0156926 A1* 6/2010 Furukawa ..... G09G 3/2003 345/589
2013/0321495 A1* 12/2013 Yoshizawa ..... G02F 1/133621 345/691

FOREIGN PATENT DOCUMENTS

JP 2004-252455 A 9/2004
JP 2013-101259 A 5/2013

* cited by examiner

*Primary Examiner* — Calvin C Ma
(74) *Attorney, Agent, or Firm* — K&L Gates LLP

(57) ABSTRACT

A display apparatus includes: a display device including a plurality of pixels each including a light emitting element; and a controller configured to control light emission timing of each of the pixels. The controller is configured to divide a time period during which a frame image is being displayed into certain unit time segments, and then switch light emission of the pixel on and off in a manner such that a light quantity per each of the unit time segment is equalized.

14 Claims, 10 Drawing Sheets

DISPLAY APPARATUS

CROSS-REFERENCE TO RELATED APPLICATIONS

This application claims priority from Japanese Application No. 2016-198798, filed on Oct. 7, 2016, the contents of which are incorporated by reference herein in its entirety.

BACKGROUND

1. Technical Field

The present invention relates to a display apparatus.

2. Description of the Related Art

Display apparatuses that include pixels using organic electroluminescence (EL) have been known (for example, Japanese Patent Application Laid-open Publication No. 2013-101259 A).

In the display apparatus using organic EL, the luminance of the pixels decreases over time after a frame image is updated. Consequently, the difference in luminance occurring before and after the update of a frame image is visually recognized as a flicker in some cases.

For the foregoing reasons, there is a need for providing a display apparatus capable of preventing flickers from occurring over a period from before to after the update.

SUMMARY

According to one aspect, a display apparatus includes a display device including a plurality of pixels each including a light emitting element, and a controller configured to control light emission timing of each of the pixels. The controller is configured to divide a time period during which a frame image is being displayed into certain unit time segments, and then switch light emission of the pixel on and off in a manner such that a light quantity per each of the unit time segment is equalized.

BRIEF DESCRIPTION OF THE DRAWINGS

FIG. 9 is a diagram schematically illustrating decreases in luminance of an organic light emitting diode that accompany decreases in capacitance in an electric-charge storing capacitor and the like;

DETAILED DESCRIPTION

The following describes an embodiment of the present invention with reference to the drawings. The disclosure is merely an example, and the present invention shall include embodiments obtained by making appropriate changes that the skilled person can easily conceive of without departing from the gist of the invention. While the drawings may illustrate geometries such as widths, thicknesses, and shapes schematically as compared with the actual geometries for the sake of clearer explanation, these geometries are illustrative only and not intended to limit the interpretation of the present invention. Throughout the description and the drawings, any element that is the same as an element already described in connection with the drawings already referred to is assigned the same reference sign, and detailed description thereof is omitted as appropriate.

Figure 1:
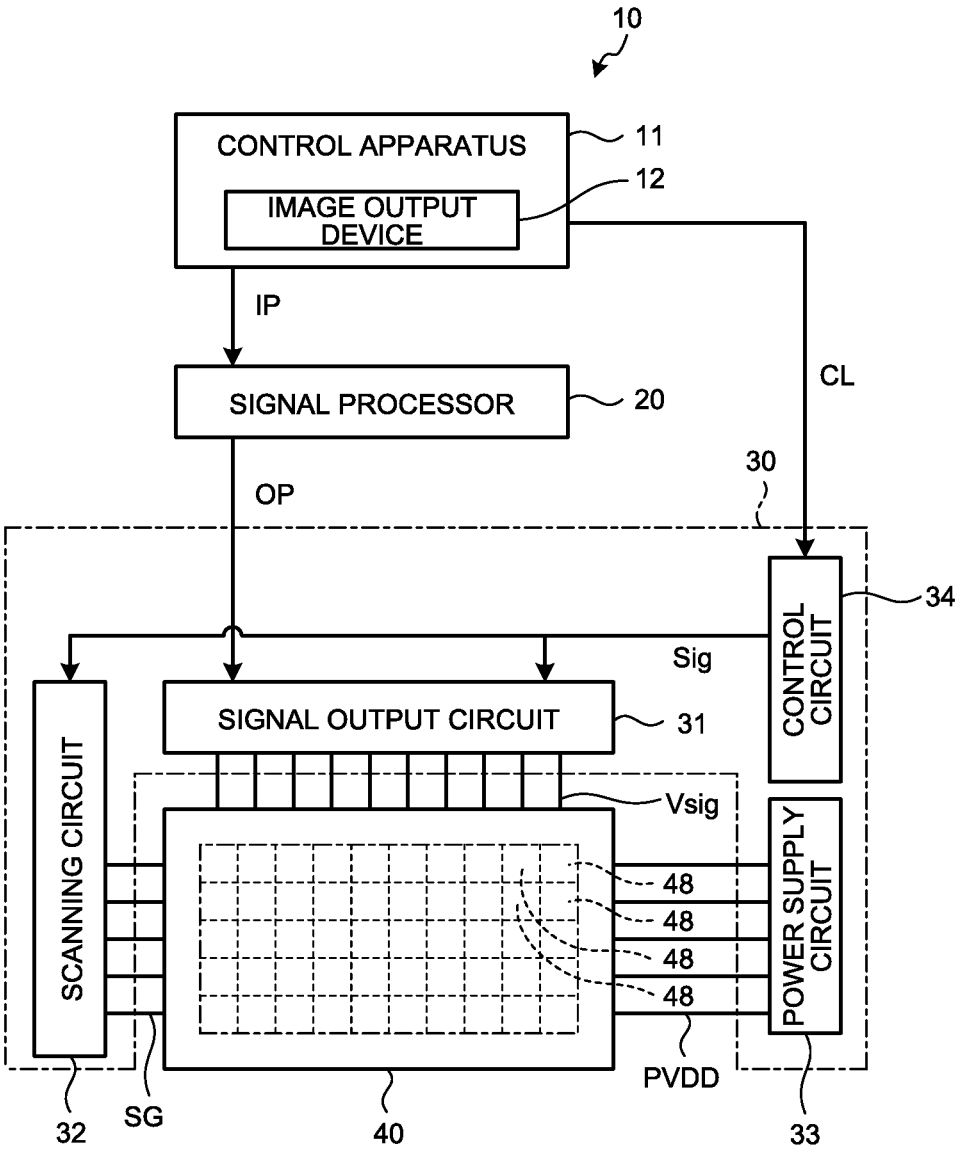
FIG. 1 is a block diagram illustrating an example of the configuration of a display apparatus according to an embodiment of the present invention.

FIG. 1 is a block diagram illustrating an example of the configuration of a display apparatus 10 according to an embodiment of the present invention. As illustrated in FIG. 1, the display apparatus 10 according to the embodiment includes a signal processor 20, an image display panel driving device 30, and an image display panel 40. The signal processor 20 receives input of input signals IP (RGB data) from an image output device 12 in a control apparatus 11, and transmits output signals OP generated by subjecting the input signals IP to a certain data conversion process to individual devices in the display apparatus 10. The image display panel driving device 30 controls driving of the image display panel 40 based on signals transmitted from the signal processor 20. The image display panel 40 is a self-emissive image display panel that displays images by, based on signals transmitted from the image display panel driving device 30, lighting up self-emissive elements in sub-pixels 49 included in each pixel 48.

Figure 2:
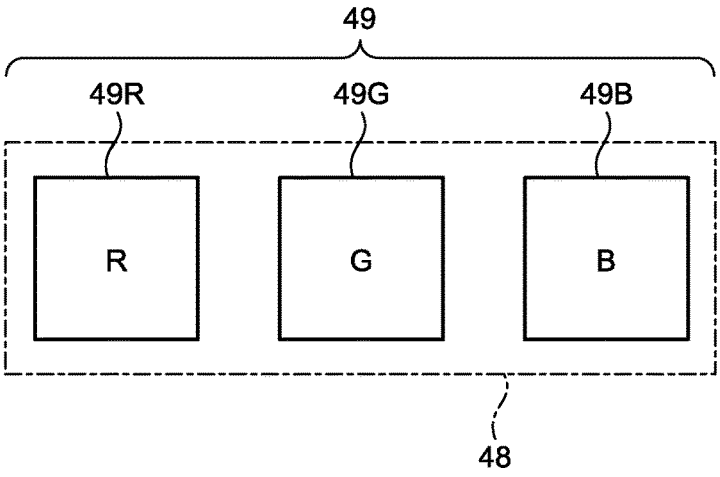
FIG. 2 is a diagram illustrating an array of sub-pixels in an image display panel according to the embodiment.
Figure 3:
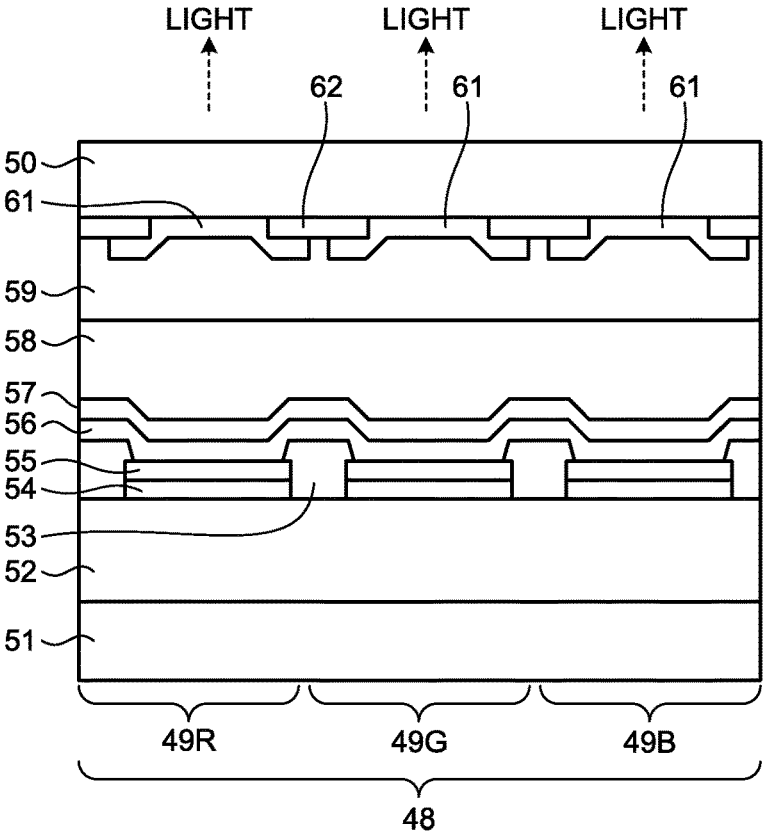
FIG. 3 is a diagram illustrating a sectional structure of the image display panel according to the embodiment.

First, the configuration of the image display panel 40 is described. FIG. 2 is a diagram illustrating an array of sub-pixels 49 in the image display panel 40 according to the embodiment. FIG. 3 is a diagram illustrating a sectional structure of the image display panel 40 according to the embodiment. As illustrated in FIG. 1, the image display panel 40 has the pixels 48, the number of which is $P_0 \times Q_0$ ($P_0$ in the row direction and $Q_0$ in the column direction), in a two-dimensional matrix (row-column configuration). Thus, the image display panel 40 that functions as a display device has an active area AA provided as a region on which the pixels 48 are provided and through which display is output.

Each of the pixels 48 includes a plurality of sub-pixels 49. Specifically, the pixel 48 includes a first sub-pixel 49R, a second sub-pixel 49G, and a third sub-pixel 49B, for example, as illustrated in FIG. 2. The first sub-pixel 49R displays, as a first color, a primary red color. The second sub-pixel 49G displays, as a second color, a primary green color. The third sub-pixel 49B displays, as a third color, a primary blue color. However, the first color, the second color, and the third color are not limited to the colors of red, green, and blue, and any colors including complementary colors may be selected as the first to third colors. Hereinafter, when there is no need to distinguish the first sub-pixel 49R, the second sub-pixel 49G, and the third sub-pixel 49B from one another, these sub-pixels are referred to as sub-pixels 49.

As illustrated in FIG. 3, the image display panel 40 includes a substrate 51, insulating layers 52 and 53, a reflecting layer 54, lower electrodes 55, a self-emissive layer 56, an upper electrode 57, insulating layers 58 and 59, color filters 61 serving as a color converting layer, a black matrix 62 serving as a light shielding layer, and a substrate 50. The substrate 51 is, for example, a semiconductor substrate of silicon or the like, a glass substrate, or a resin substrate, and has the above-described elements such as the above-described lighting drive circuit formed or mounted thereon. The insulating layer 52 is a protective film that protects the above-described elements such as the above-described lighting drive circuit, and can be formed using a material such as silicon oxide or silicon nitride. The respective lower electrodes 55 are provided for the first sub-pixel 49R, the second sub-pixel 49G, and the third sub-pixel 49B, and are conductive elements serving as anodes (positive electrodes) of organic light emitting diodes EL (refer to FIG. 6) serving as light emitting elements. The lower electrode 55 is a translucent electrode formed of a translucent conductive material (translucent conductive oxide) such as indium tin oxide (ITO). The insulating layer 53 is called a bank and is an insulating layer that defines borders among the first sub-pixel 49R, the second sub-pixel 49G, and the third sub-pixel 49B. The reflecting layer 54 is formed of a material, such as silver, aluminum, or gold, having metallic luster that reflects light emitted from the self-emissive layer 56. The self-emissive layer 56 contains an organic material and includes a hole injection layer, a hole transport layer, an emissive layer, an electron transport layer, and an electron injection layer, which are not illustrated.

As a layer that generates holes, a layer that contains an aromatic amine compound and a substance capable of accepting electrons from the compound is preferably used. An aromatic amine compound is a material having an arylamine skeleton. An aromatic amine compound that contains triphenylamine in the skeleton thereof and has a molecular weight of 400 or higher is particularly preferable. Further among aromatic amine compounds that contain triphenylamine in the skeletons thereof, one that contains a condensed aromatic ring, such as a naphthyl group, in the skeleton thereof is particularly preferable. The heat resistance of the light emitting element is improved by using an aromatic amine compound that contains triphenylamine and a condensed aromatic ring in the skeleton thereof. Examples of the aromatic amine compound include: 4-4'-bis[N-(1-naphthyl)-N-phenylamino]biphenyl (i.e., α-NPD); 4-4'-bis[N-(3-methylphenyl)-N-phenylamino]biphenyl (i.e., TPD); 4,4',4"-tris(N, N-diphenylamino)triphenylamine (i.e., TDATA); 4,4',4"-tris[N-(3-methylphenyl)-N-phenylamino]triphenylamine (i.e., MTDATA); 4-4'-bis[N-{4-(N, N-di-m-tolylamino)phenyl}-N-phenylamino]biphenyl (i.e., DNTPD); 1,3,5-tris[N, N-di(m-tolyl)-amino]benzene (i.e., m-MTDAB); 4,4'4"-tris(N-carbazolyl)triphenylamine (i.e., TCTA); 2-3-bis(4-diphenylaminophenyl)quinoxaline (i.e., TPAQn); 2,2',3,3'-tetrakis(4-diphenylaminophenyl)-6,6'-bisquinoxaline (i.e., D-TriPhAQn); and 2-3-bis{4-[N-(1-naphthyl)-N-phenylamino]phenyl}-dibenzo[f,h]quinoxaline (i.e., NPADiBzQn). The substance capable of accepting electrons from the aromatic amine compound is not particularly limited, and examples thereof include: molybdenum oxide; vanadium oxide; 7,7,8,8-tetracyanoquinodimethane (i.e., TCNQ); and 2,3,5,6-tetrafluoro-7,7,8,8-tetracyanoquinodimethane (i.e., F4-TCNQ).

An electron transport substance is not particularly limited, and examples thereof include: metal complexes such as tris(8-hydroxyquinolinato)aluminum (i.e., $Alq_3$), tris(4-methyl-8-hydroxyquinolinato)aluminum (i.e., $Almq_3$), bis(10-hydroxybenzo[h]quinolinato)beryllium (i.e., $BeBq_2$), bis(2-methyl-8-hydroxyquinolinato)-4-phenylphenolato-aluminum (i.e., BAlq), bis[2-(2-hydroxyphenyl)benzoxazolato]zinc (i.e., $Zn(BOX)_2$), and bis[2-(2-hydroxyphenyl)benzothiazolate]zinc (i.e., $Zn(BTZ)_2$); 2-(4-biphenyl)-5-(4-tert-butylphenyl)-1,3,4-oxydiazole (i.e., PBD); 1,3-bis[5-(p-tert-butylphenyl)-1,3,4-oxydiazole-2-yl]benzene (i.e., OXD-7); 3-(4-tert-butylphenyl)-4-phenyl-5-(4-biphenylyl)-1,2,4-triazole (i.e., TAZ), 3-(4-tert-butylphenyl)-4-(4-ethylphenyl)-5-(4-biphenylyl)-1,2,4-triazole (i.e., p-EtTAZ); bathophenanthroline (i.e., BPhen); and bathocuproin (i.e., BCP). A substance capable of donating electrons to the electron transport substance is not particularly limited, and examples thereof include: alkali metal such as lithium or cesium; alkali earth metal such as magnesium or calcium; and rare earth metal such as erbium or ytterbium. As the substance capable of donating electrons to the electron transport substance, a substance selected from alkali metal oxide and alkali earth metal oxide, such as lithium oxide ($Li_2O$), calcium oxide (CaO), sodium oxide ($Na_2O$), potassium oxide ($K_2O$), and magnesium oxide (MgO) may be used.

For example, reddish light can be obtained by using a substance having an emission spectrum peak at 600 nm to 680 nm, such as: 4-dicyanomethylene-2-isopropyl-6-[2-(1,1,7,7-tetramethyljulolidine-9-yl)ethenyl]-4H-pyran (i.e., DCJTI); 4-dicyanomethylene-2-methyl-6-[2-(1,1,7,7-tetramethyljulolidine-9-yl)ethenyl]-4H-pyran (i.e., DCJT); 4-dicyanomethylene-2-tert-butyl-6-[2-(1,1,7,7-tetramethyl-julolidine-9-yl)-ethenyl]-4H-pyran (i.e., DCJTB); periflanthene; or 2,5-dicyano-1,4-bis[2-(10-methoxy-1,1,7,7-tetramethyljulolidine-9-yl)ethenyl]benzene. Greenish light can be obtained by using a substance having an emission spectrum peak at 500 nm to 550 nm, such as: N,N'-dimethylquinacridone (i.e., DMQd); coumarin-6; coumarin-545T; or tris(8-hydroxyquinolinato)aluminum (i.e., $Alq_3$). Bluish light can be obtained by using a substance having an emission spectrum peak at 420 nm to 500 nm, such as: 9,10-bis(2-naphthyl)-tert-butylanthracene (i.e., t-BuDNA); 9,9'-bianthryl, 9,10-diphenylanthracene (i.e., DPA); 9,10-bis(2-naphthyl)anthracene (i.e., DNA); bis(2-methyl-8-hydroxyquinolinato)-4-phenylphenolato-gallium (i.e., BGaq); or bis(2-methyl-8-hydroxyquinolinato)-4-phenylphenolato-aluminum (i.e., BAlq). Instead of using a fluorescent substance as described above, a phosphorescent substance may be used as an emissive substance, such as: bis[2-(3,5-bis(trifluoromethyl)phenyl)pyridinato-N,C2']iridium(III)picolinate (i.e., $Ir(CF_3ppy)_2(pic)$); bis[2-(4,6-difluorophenyl)pyridinato-N,C2']iridium(III)acetylacetonate (i.e., FIr(acac)), bis[2-(4,6-difluorophenyl)pyridinato-N,C2']iridium(III)picolinate (i.e., FIr(pic)); or tris(2-phenylpyridinato-N,C2')iridium (i.e., $Ir(ppy)_3$).

The upper electrode 57 is a trancelucent electrode formed of a translucent conductive material (translucent conductive oxide) such as indium tin oxide (ITO). This embodiment provides ITO as an example of the translucent conductive material, but is not limited thereto. As the translucent conductive material, a conductive material having a different composition, such as indium zinc oxide (IZO), may be used. The upper electrode 57 serves as the cathode (negative electrode) of the organic light emitting diode EL. The insulating layer 58 is a sealing layer that seals the upper electrode 57 and may be made of silicon oxide, silicon nitride, or the like. The insulating layer 59 is a planarizing layer that evens out level differences attributable to the bank and may be made of silicon oxide, silicon nitride, or the like. The substrate 50 is a translucent substrate that protects the entire image display panel 40 and may be, for example, a glass substrate. While FIG. 3 illustrates an example in which the lower electrode 55 and the upper electrode 57 serve as an anode (positive electrode) and a cathode (negative electrode), respectively, this example is not limiting. The lower electrode 55 and the upper electrode 57 may serve as a cathode and an anode, respectively. In such a case, the polarity of the drive transistor DRT (refer to FIG. 6) electrically coupled to the lower electrode 55 may be changed as appropriate, and the order in which carrier injection layers (the hole injection layer and the electron injection layer), carrier transport layers (the hole transport layer and the electron transport layer), and the emissive layer are stacked on one another may be changed as appropriate.

The image display panel 40 is a color display panel and includes the color filters 61 arranged between the respective sub-pixels 49 and an observer of the images, which are configured so that color components of light emitted by the self-emissive layer 56 that correspond to the colors of the respective sub-pixels 49 may be allowed to pass therethrough. The image display panel 40 is capable of emitting light of colors that correspond to red, green, blue, and white. The image display panel 40 may be configured to emit the respective colors of the first sub-pixel 49R, the second sub-pixel 49G, and the third sub-pixel 49B without causing color components of light emitted by the self-emissive layer 56 to pass through any color converting layer such as the color filters 61.

Figure 4:
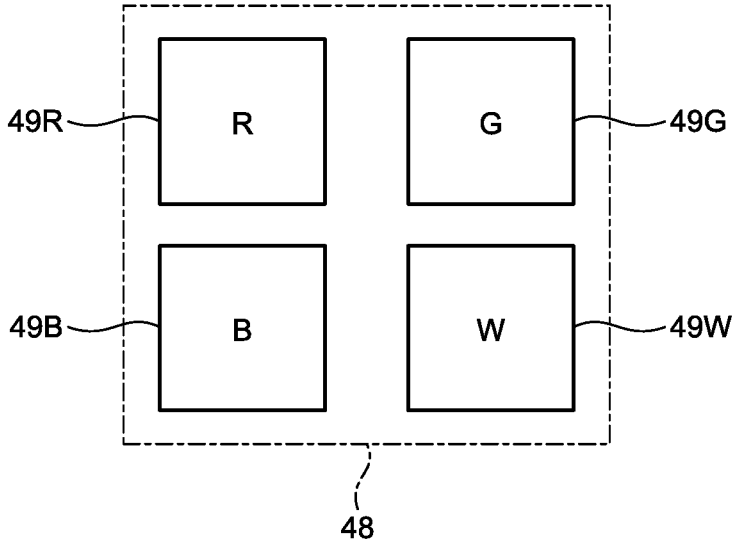
FIG. 4 is a diagram illustrating an alternative array of sub-pixels in the image display panel according to the embodiment.

FIG. 4 is a diagram illustrating an alternative array of the sub-pixels 49 in the image display panel 40 according to the embodiment. The image display panel 40 includes pixels 48 each having the sub-pixels 49 arranged in a matrix (row-column configuration) of two rows and two columns. These sub-pixels 49 are the first sub-pixel 49R, the second sub-pixel 49G, the third sub-pixel 49B, and a fourth sub-pixel 49W. The fourth sub-pixel 49W displays a fourth color (for example, white) that is different from the first color, the second color, and the third color. The image display panel 40 may thus have the sub-pixels 49 in each of the pixels 48 arrayed as desired. The color filter 61 corresponding to white that is otherwise arranged between the fourth sub-pixel 49W and the observer of the images may be excluded or may be replaced by a transparent resin layer. The transparent resin layer thus provided can contribute to preventing formation of a large level difference attributable to the fourth sub-pixel 49W.

The signal processor 20 generates an output signal OP by processing an input signal IP input thereto from the control apparatus 11. The signal processor 20 converts an input value indicated by the input signal IP into and generates the output signal OP that indicates an extended value in a color space, the input value being determined by how red (the first color), green (the second color), and blue (the third color) are combined, the extended value being represented by how the colors of the sub-pixels 49 are combined. The signal processor 20 then outputs the generated output signal OP to the image display panel driving device 30.

The image display panel driving device 30 includes, for example, a signal output circuit 31, a scanning circuit 32, a power supply circuit 33, and a control circuit 34. The signal output circuit 31 functions as what is called a source driver, and assigns the output signals OP output from the signal processor 20 to the individual sub-pixels 49, and outputs the output signals OP to the individual sub-pixels 49 through signal lines Vsig. The scanning circuit 32 functions as what is called a gate driver and outputs various signals including a drive signal for driving the sub-pixels 49 row by row. The power supply circuit 33 generates a voltage for generating a current that flows through the organic light emitting diode EL. Specifically, the power supply circuit 33 generates a voltage indicating a potential higher than the potential of a low-potential part PVSS (refer to FIG. 6) and supplies the voltage to a high-potential part PVDD. The control circuit 34 controls when to cause the sub-pixels 49 included in each of the pixels 48 to emit light. The control circuit 34 also controls the operation of the signal output circuit 31 and the scanning circuit 32 by outputting signals (operation control signals Sig) relating to the operation of the signal output circuit 31 and the scanning circuit 32. The operation control signals Sig include, for example, a clock signal input to the signal output circuit 31 and the scanning circuit 32. The clock signal is, for example, output in response to a synchronization signal CL output from the control apparatus 11 so that the control circuit 34 can operate in synchronization with the input signal IP.

Figure 5:
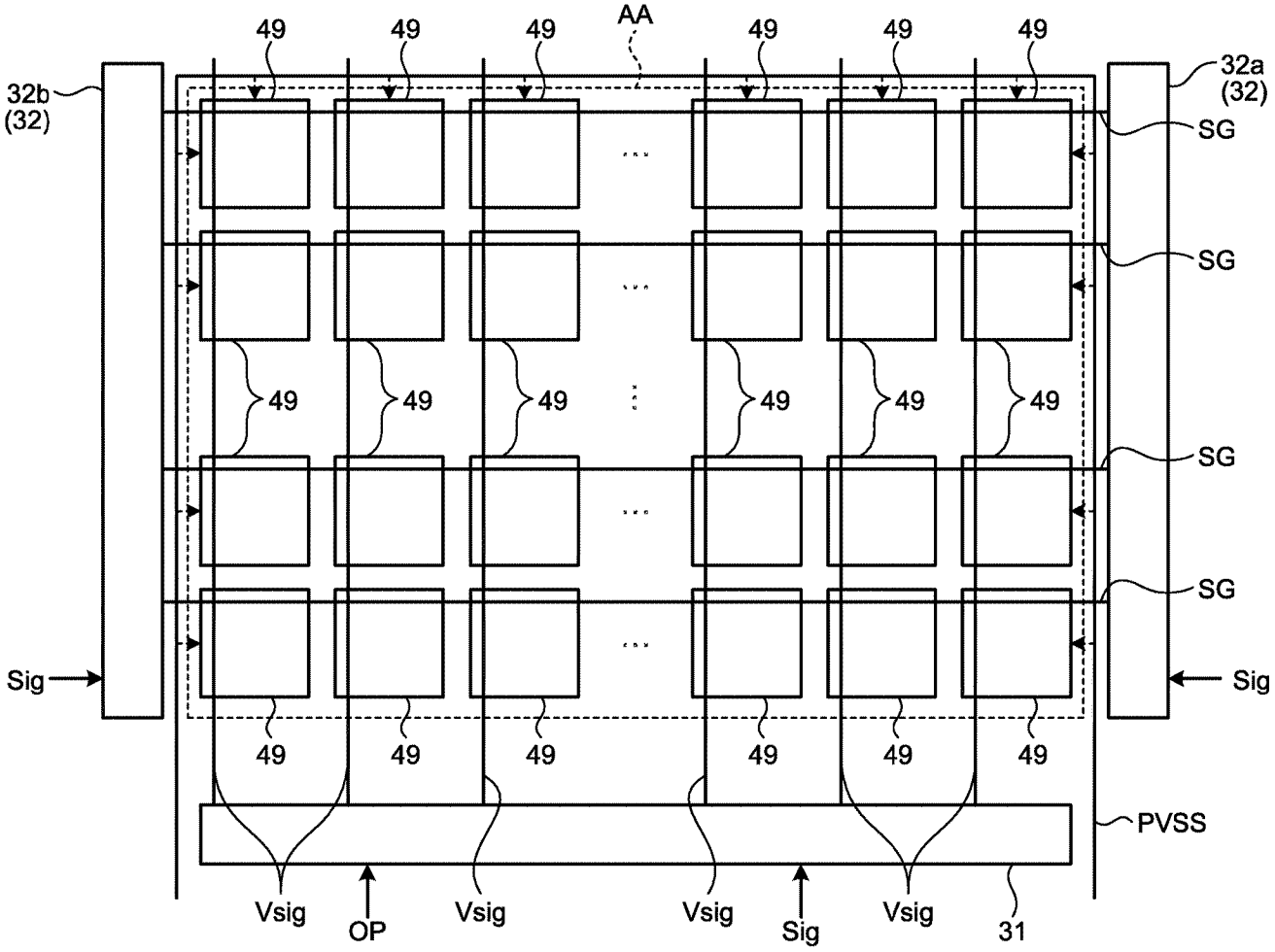
FIG. 5 is a schematic diagram illustrating an example of the coupling relations of components of an image display panel driving device with a sub-pixel.
Figure 6:
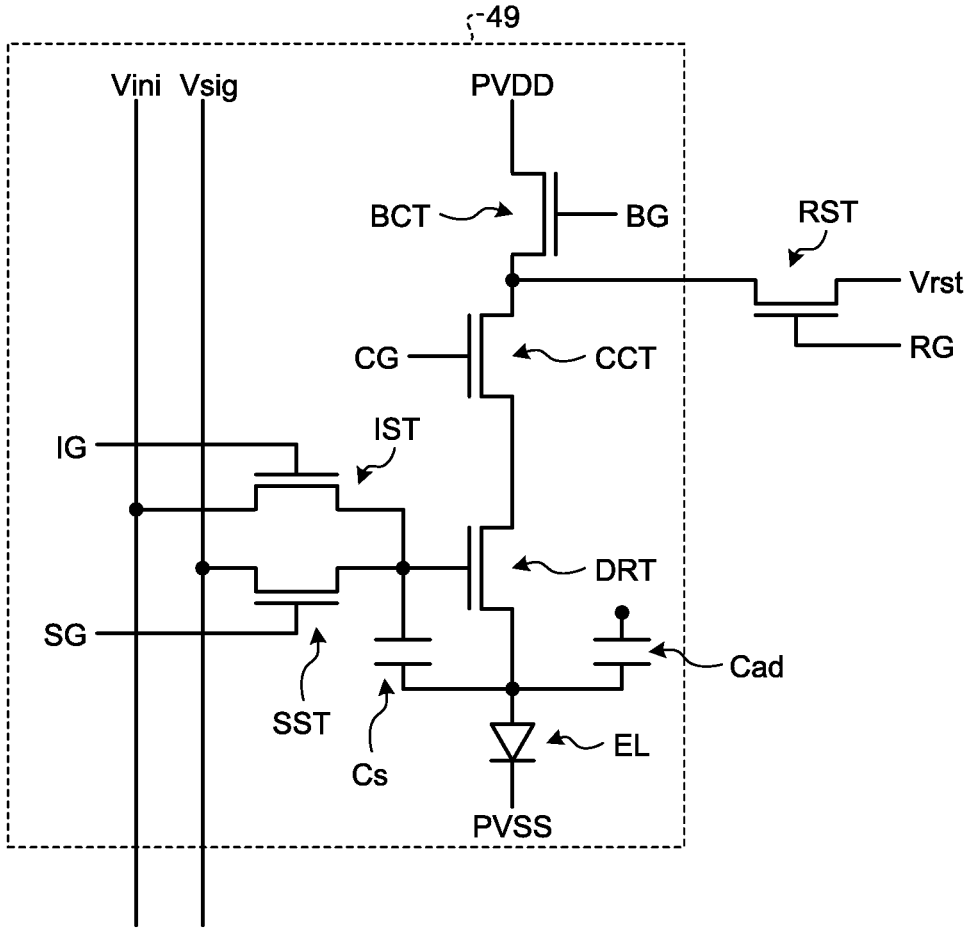
FIG. 6 is a schematic circuit diagram illustrating an example of a configuration relating to sub-pixels.

The following describes the relation of the image display panel driving device 30 with the sub-pixel 49. FIG. 5 is a schematic diagram illustrating an example of the coupling relations of components of the image display panel driving device 30 with the sub-pixel 49. FIG. 6 is a schematic circuit diagram illustrating an example of a configuration relating to the sub-pixel 49. As illustrated in FIG. 1 and FIG. 5, the signal output circuit 31 is coupled to each of the sub-pixels 49 included in the pixel 48 through the signal line Vsig. The scanning circuit 32 is also coupled to each of the sub-pixels 49 included in the pixel 48 through a scanning line SG. Each of the signal lines Vsig is shared by the sub-pixels 49 that are lined up in the column-wise direction. Each of the scanning lines SG is shared by the sub-pixels 49 that are lined up in the row-wise direction. The signal output circuit 31 outputs the output signal OP to the signal line Vsig. The scanning circuit 32 output a drive signal to the scanning line SG. While FIG. 5 illustrates the scanning circuit 32 that is provided as two scanning circuits 32*a* and 32*b* that extend along two opposite sides of the active area AA, the illustration is merely a specific configuration example of the scanning circuit 32, which is not limiting and can be changed as appropriate.

As illustrated in FIG. 6, the sub-pixel 49 includes a control transistor SST, a drive transistor DRT, an electric-charge storing capacitor Cs, an EL power-supply opening/closing transistor BCT, and a light emission control transistor CCT. An alternative configuration may be employed in which the EL power-supply opening/closing transistor BCT and the light emission control transistor CCT are shared by two or more sub-pixels (for example, the first sub-pixel 49R, the second sub-pixel 49G, and the third sub-pixel 49B that are included in one of the pixels 48). The gate of the control transistor SST is coupled to the scanning line SG, the drain thereof is coupled to the signal line Vsig, the source is coupled to the gate of the drive transistor DRT. One end of the electric-charge storing capacitor Cs is coupled to the gate of the drive transistor DRT, and the other end thereof is coupled to the source of the drive transistor DRT. The drain of the drive transistor DRT is coupled to the side of the high-potential part PVDD, and the source of the drive transistor DRT is coupled to the anode side of the organic light emitting diode EL, which is a self-emissive layer. The cathode of the organic light emitting diode EL is coupled to, for example, the low-potential part PVSS (for example, an electrode that indicates a reference voltage as a ground) that functions as a reference potential. While FIG. 6 illustrates an example in which n-channel transistors are used as the control transistor SST and the drive transistor DRT, the polarities of these transistors are not limited. The polarities of the control transistor SST and the drive transistor DRT may be determined as needed. While FIG. 5 illustrates arrows drawn from the low-potential part PVSS and leading to only the sub-pixels 49 that are adjacent to the low-potential part PVSS, the low-potential part PVSS actually has an electrode that has a surface part covering the entirety of the active area AA, and all of the sub-pixels 49 are coupled to the low-potential part PVSS.

The control transistor SST operates so as to supply a current into the electric-charge storing capacitor Cs, the current corresponding to the output signal OP being output to the signal line Vsig while the drive signal is being output to the scanning line SG. The electric-charge storing capacitor Cs stores therein electric charge corresponding to the output signal OP as an electrostatic capacitance, and determines a current to flow between the source and the drain of the drive transistor DRT. A voltage between the source and the drain of the drive transistor DRT becomes the difference in potential between the high-potential part PVDD and the low-potential part PVSS. In this state, when the drive transistor DRT operates in accordance with electric charge stored in the electric-charge storing capacitor Cs, a current based on this voltage is fed through the organic light emitting diode EL. The current corresponding to the output signal OP is thus fed through the organic light emitting diode EL.

In this embodiment, a capacitor Cad is provided to the source of the drive transistor DRT to which the other end of the electric-charge storing capacitor Cs is coupled. The capacitor Cad stores therein electric charge.

Between the high-potential part PVDD and the low-potential part PVSS, the EL power-supply opening/closing transistor BCT is provided to the drain side of the drive transistor DRT. The gate of the EL power-supply opening/closing transistor BCT is coupled to the EL power-supply opening/closing signal line BG, the drain thereof is coupled to the high-potential part PVDD, and the source thereof is coupled to the drain side of the drive transistor DRT, which is provided to the low-potential part PVSS side. The EL power-supply opening/closing transistor BCT conducts electricity when a signal output to the EL power-supply opening/closing signal line BG is high.

A resetting signal line Vrst for resetting the output from the sub-pixel 49 is coupled to a part between the EL power-supply opening/closing transistor BCT and the drive transistor DRT. To prevent a current from flowing into the organic light emitting diode EL, a voltage applied to the resetting signal line Vrst is set to a voltage (for example, −2 V) 1 V to 2 V lower than the lower-potential part PVSS. A resetting transistor RST is provided to the resetting signal line Vrst. The gate of the resetting transistor RST is coupled to a resetting signal line RG, and the source and the drain thereof are provided halfway through the resetting signal line Vrst. The scanning circuit 32 sets a signal output to the EL power-supply opening/closing signal line BG low prior to update of a frame image to shut off the path that feeds a high potential from the high-potential part PVDD, and a signal output to the resetting signal line RG high to reset wiring between the source of the EL power-supply opening/closing transistor BCT and the anode.

The source of the capacitor initializing transistor IST is further coupled to wiring between the gate of the drive transistor DRT, to which the one end of the electric-charge storing capacitor Cs is coupled, and the control transistor SST. The gate of the capacitor initializing transistor IST is coupled to a capacitor initializing signal line IG, and the drain thereof is coupled to an initializing potential part Vini. The voltage of the initializing potential part Vini is set to a voltage (e.g., 1.2 V to 1.3 V) for initializing any capacitors (such as the electric-charge storing capacitor Cs) coupled to the source of the drive transistor DRT. The scanning circuit 32 sets a signal output to the capacitor initializing signal line IG high prior to update of a frame image to initialize the capacitances of the electric-charge storing capacitor Cs and the like, thereby initializing the light emission status of the organic light emitting diode EL that is dependent on a gradation value indicated by the output signal OP. Thereafter, the signal output circuit 31 outputs the output signal OP to the signal line Vsig in accordance with the time when the scanning circuit 32 again outputs the drive signal to the scanning line SG, whereby output from the sub-pixel 49 is updated. The frame image is updated upon completion of updating outputs from all of the sub-pixels 49. While the low-potential part PVSS is set to 0 V or lower than 0 V in this embodiment, this example is illustrative only and not limiting.

In this embodiment, the light emission control transistor CCT is provided on wiring for the organic light emitting diode EL that couples the high-potential part PVDD and the low-potential part PVSS to each other. The gate of the light emission control transistor CCT is coupled to a light emission control signal line CG, and the source and the drain thereof are provided on the wiring for the organic light emitting diode EL that couples the high-potential part PVDD and the low-potential part PVSS to each other. More specifically, the drain of the light emission control transistor CCT is coupled to the source of the EL power-supply opening/closing transistor BCT, and the source thereof is coupled to the drain of the drive transistor DRT. This example, however, is merely an example of the arrangement of the light emission control transistor CCT and not limiting and can be changed as appropriate. The light emission control transistor CCT functions as a switch that, depending on whether a signal output from the scanning circuit 32 to the light emission control signal line CG is high or low, connects or disconnects the wiring for the organic light emitting diode EL that couples the high-potential part PVDD and the low-potential part PVSS to each other. While the light emission control transistor CCT is disconnecting the wiring, the organic light emitting diode EL does not emit light.

Figure 7:
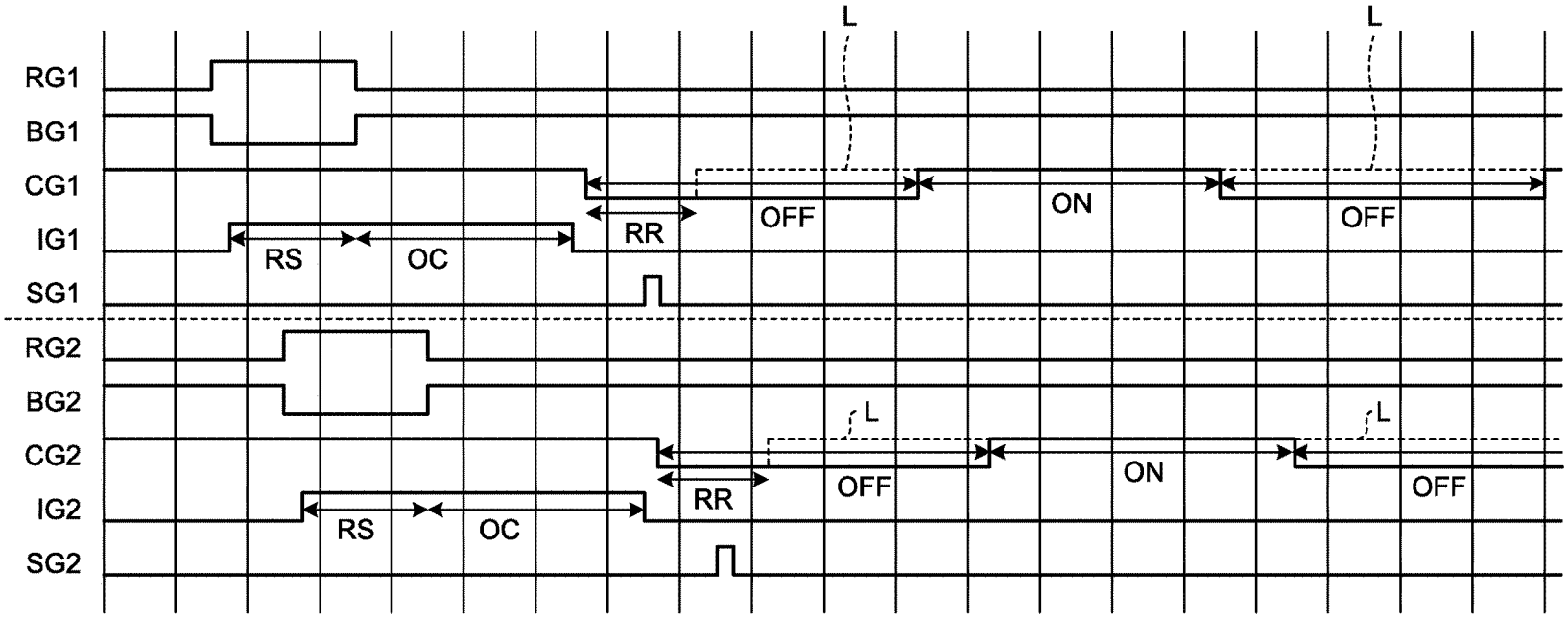
FIG. 7 is a timing chart illustrating output examples of various signals for resetting sub-pixels and for light emission.

FIG. 7 is a timing chart illustrating output examples of various signals for resetting the sub-pixels 49 and for light emission. In this embodiment, the reset operation and update of the output signal OP are performed row by row of the sub-pixels 49. In FIG. 7, regarding adjacent two rows of the sub-pixels 49, RG1, BG1, CG1, IG1, and SG1 denote the resetting signal line RG, the EL power-supply opening/closing signal line BG, the light emission control signal line CG, the capacitor initializing signal line IG, and the scanning line SG that are coupled to one of the two rows of the sub-pixels 49 that is to be reset earlier than the other. In FIG. 7, regarding the adjacent two rows of the sub-pixels 49, RG2, BG2, CG2, IG2, and SG2 denote the resetting signal line RG, the EL power-supply opening/closing signal line BG, the light emission control signal line CG, the capacitor initializing signal line IG, and the scanning line SG that are coupled to one of the two rows of the sub-pixels 49 that is to be reset later than the other. While FIG. 7 illustrates timings of various signals only regarding two rows of the sub-pixels 49, the same relations apply to any adjacent two rows of the sub-pixels 49 among the other sub-pixels 49. That is, the image display panel 40 according to this embodiment is provided so that scanning for resetting the sub-pixels 49 and updating the output signal OP is performed in the column direction. The following description uses terms the resetting signal line RG, the EL power-supply opening/closing signal line BG, the light emission control signal line CG, the capacitor initializing signal line IG, and the scanning line SG when there is no need to distinguish RG1, BG1, CG1, IG1, and SG1 from RG2, BG2, CG2, IG2, and SG2.

First, the sequence of signals with respect to each of the rows is described. Prior to operation to initialize the electric-charge storing capacitor Cs, a signal output to the EL power-supply opening/closing signal line BG is switched from high to low, and, at the same time, a signal output to the resetting signal line RG is switched from low to high. As a result, current that has been flowing between the high-potential part PVDD and the low-potential part PVSS through the EL power-supply opening/closing transistor BCT is blocked, and, at the same time, the wiring between the EL power-supply opening/closing transistor BCT and the anode is reset with a voltage applied to the resetting signal line Vrst. Thereafter, a signal output to the capacitor initializing signal line IG is switched from low to high. RG1 is switched from high to low, whereas BG1 is switched from low to high. As a result, the electric-charge storing capacitor Cs is initialized, via the capacitor initializing transistor IST, with a voltage applied to the initializing potential part Vini. In this embodiment, a period for which a signal output to the capacitor initializing signal line IG is set high is composed of a reset period RS and an offset cancellation period OC for the electric-charge storing capacitor Cs. This reset period corresponds to a reset associated with Vrst, whereas this offset cancellation period is an initializing period associated with Vini. The signal output to the EL power-supply opening/closing signal line BG, the signal output to which has been set low prior to initializing the electric-charge storing capacitor Cs, is set high at the end of the reset period RS for the electric-charge storing capacitor Cs. The signal output to the resetting signal line RG, the signal output to which has been set high, is set low at the end of the reset period RS for the electric-charge storing capacitor Cs. At the end of the offset cancellation period OC, the signal output to the capacitor initializing signal line IG is switched from high to low. Thereafter, a signal output to the light emission control signal line CG is switched from high to low. As a result, current that has been flowing between the high-potential part PVDD and the low-potential part PVSS through the light emission control transistor CCT is blocked. Thereafter, the initializing operation is completed. Following this blockage, a signal output to the scanning line SG is switched from low to high. As a result, current corresponding to the output signal OP output from the signal output circuit 31 through the signal line Vsig flows into the electric-charge storing capacitor Cs and the like through the control transistor SST. That is, the electric-charge storing capacitor Cs and the like store therein electric charge corresponding to the output signal OP.

When to switch the signal output to the scanning line SG from low to high is within a reload period RR that corresponds to the beginning of a period starting when the signal output to the light emission control signal line CG is switched from high to low after the offset cancellation period OC. Thereafter, if the signal output to the light emission control signal line CG is switched from low to high, current corresponding to the capacitances of the electric-charge storing capacitor Cs and the like flows between the high-potential part PVDD and the low-potential part PVSS, so that the organic light emitting diode EL is brought into a state of emitting light (ON state). In contrast, if the signal output to the light emission control signal line CG is set low, current that has been flowing between the high-potential part PVDD and the low-potential part PVSS is blocked by the light emission control transistor CCT, so that the organic light emitting diode EL is brought into a state of emitting no light (OFF state). FIG. 7 illustrates, using the signs "ON" and "OFF", an example of switching between the ON and OFF states based on the signal output to the light emission control signal line CG. The OFF state may continue from the reload period RR. When the ON state is set to the longest possible period, the signal output to the light emission control signal line CG assumes a pattern indicated by the broken lines L.

The sequence in which signals are output to the resetting signal line RG, the EL power-supply opening/closing signal line BG, the light emission control signal line CG, the capacitor initializing signal line IG, and the scanning line SG is as described above with respect to each row of the sub-pixels 49. However, with respect to two or more rows of the sub-pixels 49, the reset period RS for one row starts before the end of the reset period RS for another row. Specifically, as illustrated in FIG. 7, switching between high and low starts with RG1 and BG1, followed in order by IG1, RG2 and BG2, IG2, CG1, SG1, CG2, and SG2. While this embodiment illustrates a case in which the resetting, the reloading, and the switching of the light emission states, and the like are controlled row by row, these steps may be controlled in units of two or more rows.

The timings when the scanning circuit 32 is to output the output signal OP are described hereinabove. These output timings are determined by the control circuit 34. Specifically, an operation control signal Sig that functions as instructions from the control circuit 34 to the scanning circuit 32 contains instructions relating to the timings when signals should be output to the resetting signal line RG, the EL power-supply opening/closing signal line BG, the light emission control signal line CG, the capacitor initializing signal line IG, and the scanning line SG for each row. The scanning circuit 32 operates in accordance with these instructions, so that output timing control as illustrated in FIG. 7 is implemented. In other words, the control circuit 34 can switch the organic light emitting diode EL between the ON and OFF states, for example, by switching output patterns of a signal to the light emission control signal line CG in a period starting at the end of the reload period RR and ending when output patterns of signals to the resetting signal line RG and to the EL power-supply opening/closing signal line BG are switched.

Figure 8:
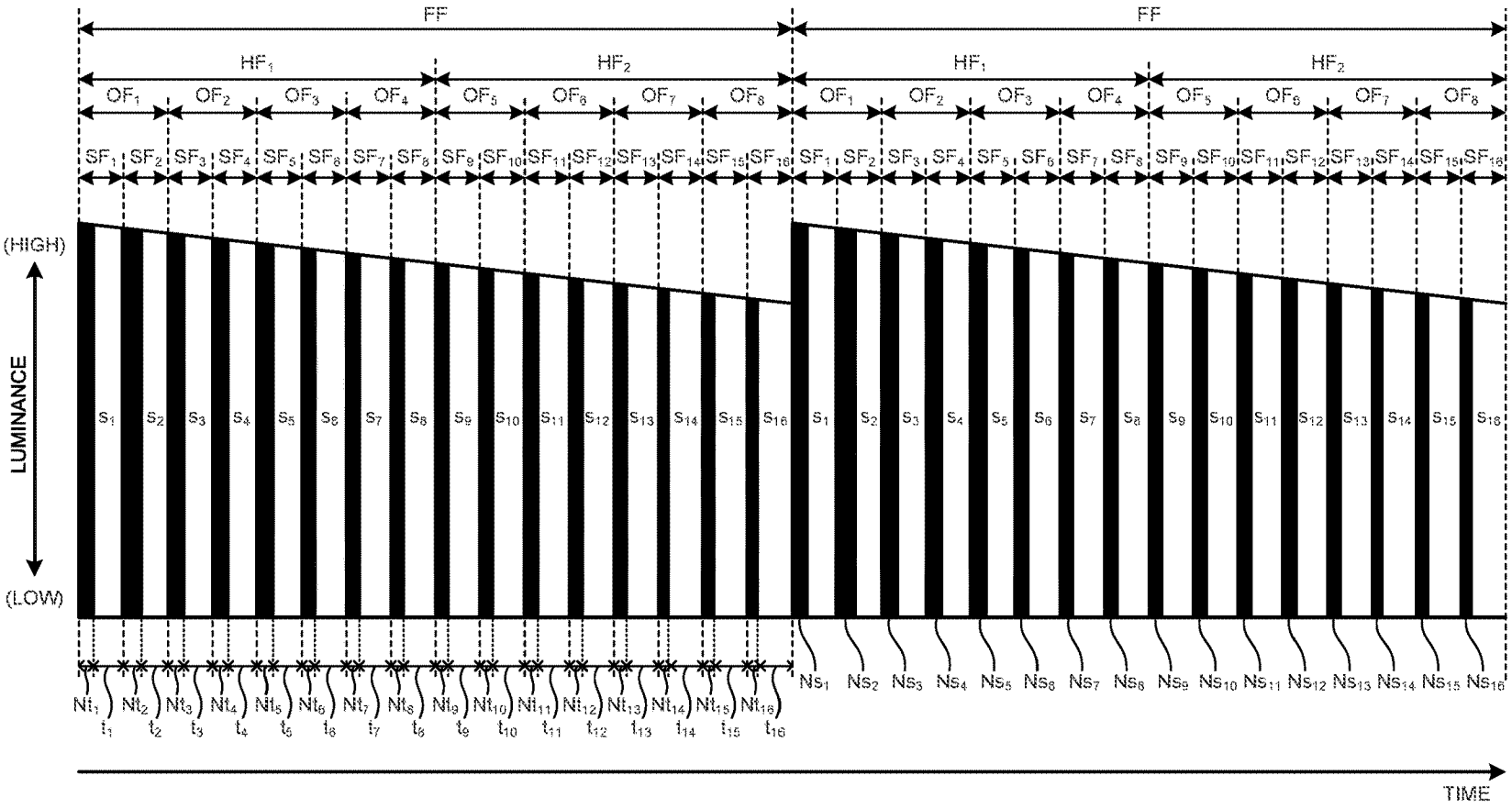
FIG. 8 is a diagram illustrating an example of switching between ON and OFF states by a control circuit.

FIG. 8 is a diagram illustrating an example of the switching between the ON and OFF states by the control circuit 34. The control circuit 34 that functions as a controller divides a time period during which a frame image is displayed into certain unit time segments, and switches light emission of the sub-pixels 49 on and off in a manner such that a light quantity per each of the unit time segments is equalized, which is to be described later. Specifically, as illustrated in FIG. 8 for example, the control circuit 34 equally divides a one-frame period FF into a plurality of unit time segments (for example, eight unit time segments $OF_1$, $OF_2$, $OF_3$, $OF_4$, $OF_5$, $OF_6$, $OF_7$, and $OF_8$) and outputs, to the scanning circuit 32, an instruction indicating an output pattern of a signal to the light emission control signal line CG, the output pattern corresponding to a light emission pattern of the organic light emitting diode EL in which a light quantity per each of the unit time segments is equalized. The output pattern is previously determined based on, for example, results of pre-examination such as measurement of luminance and a light quantity per unit time segment, the control circuit 34 is implemented so as to output instructions using the output pattern.

Figure 9:
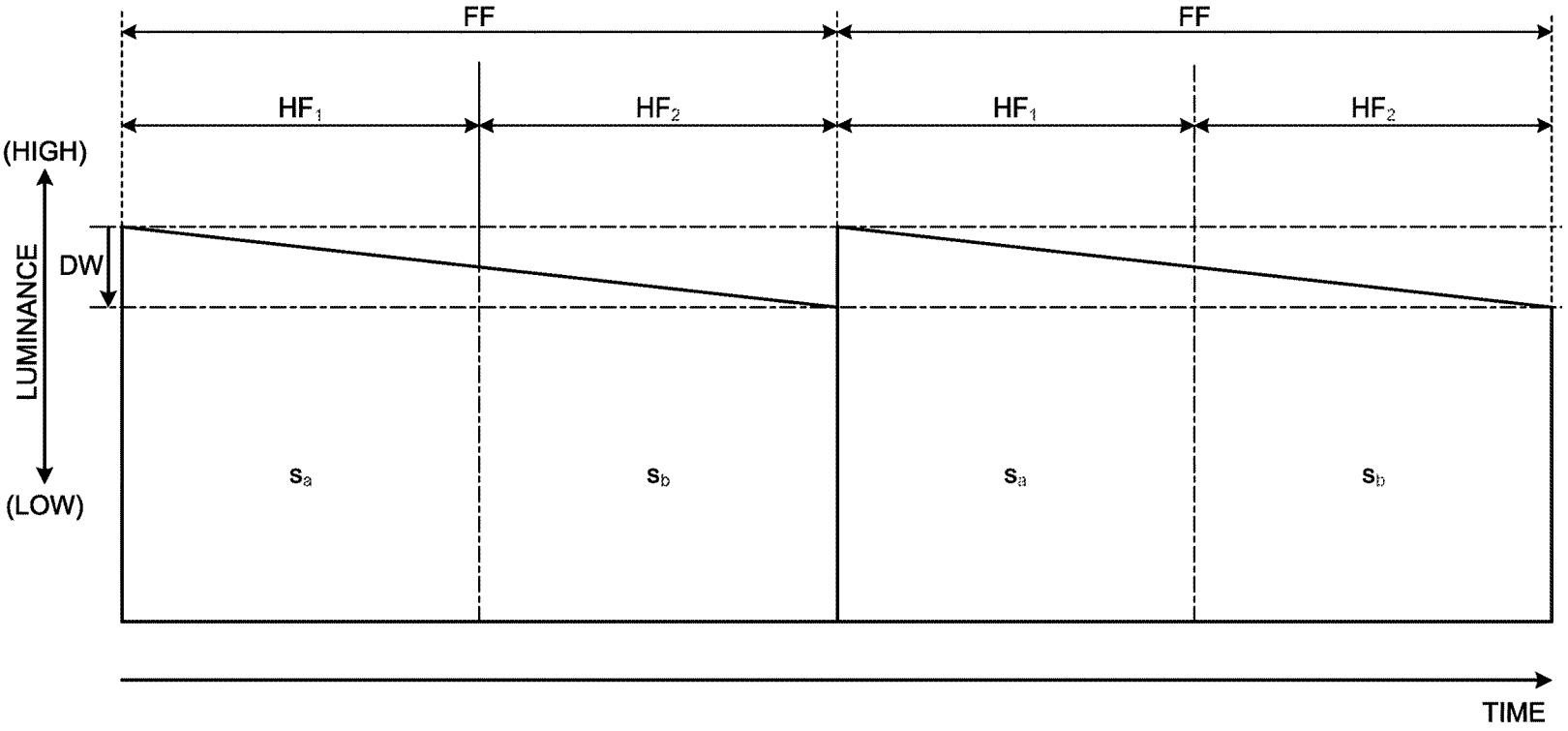

FIG. 9 is a diagram schematically illustrating decreases in luminance of the organic light emitting diode EL due to decreases in electric charge in the electric-charge storing capacitor Cs and the like. In the one-frame period FF, while the gradation value of the sub-pixel 49 is not updated and is kept uniform, electric charge decreases actually as a result of leakage from the electric-charge storing capacitor Cs and the like. Such decrease in electric charge results in decrease in luminance of the organic light emitting diode EL within each one of the one-frame periods FF, as illustrated in FIG. 9 for example. A state of luminance due to the decrease in electric charge returns to a previous state in which electric charge had not decreased, after the elapse of the reset period RS and the reload period RR for display of the next frame image. The change in the amount of electric charge due to electric charge returning to the previous state possibly causes an abrupt change in luminance of the organic light emitting diode EL. Specifically, for example, if the gradation value of the sub-pixel 49 stays unchanged at the maximum gradation value over a period from before to after a frame image is updated, the difference in luminance of the organic light emitting diode EL occurring before and after the frame image is updated coincides with a luminance decrease DW that has occurred in the one-frame period FF. Here, the one-frame period FF is halved into half-frame periods $HF_1$ and $HF_2$. The light quantities $S_a$ and $S_b$ of the organic light emitting diode EL are compared with each other during half-frame periods $HF_1$ and $HF_2$ respectively. In the comparison, the light quantity $S_b$ in the succeeding half-frame period $HF_2$ is lower than the light quantity $S_a$ in the preceding half-frame period $HF_1$. Such decrease of the light intensity may be visually recognized as a flicker, which is partially attributable to degradation in display quality of displayed output contents.

For this reason, in this embodiment, a time period during which a frame image is being displayed is divided into certain unit time segments (for example, eight unit time segments $OF_1$, $OF_2$, $OF_3$, $OF_4$, $OF_5$, $OF_6$, $OF_7$, and $OF_8$), and light emission of a pixel is switched on and off in a manner such that light quantity per each of the unit time segments is equalized. In a specific example of such switching, the controller sets up a plurality of light emission time slots and a plurality of no-light emission time slots within each of the unit time segments. The pixel is emitting light in the light emission time slot (for example, a light emission time slot $t_1$ described later), whereas the pixel is not emitting light in the no-light emission time slot (for example, a no-light emission time slot $Nt_1$ described later). The term "pixel" used herein means the sub-pixels 49 included in each pixel 48 insofar as this embodiment concerns.

Figure 10:
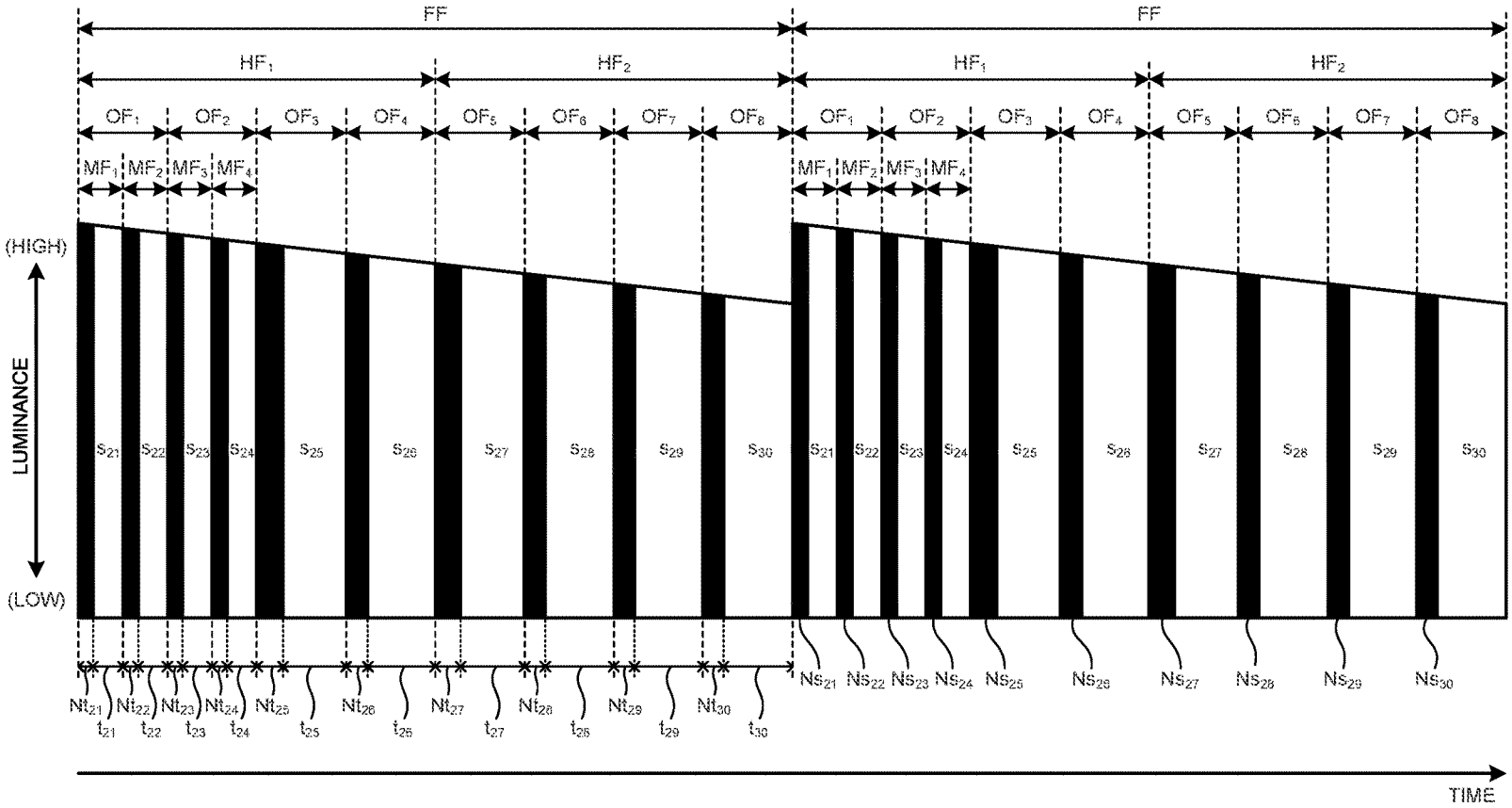
FIG. 10 is a diagram illustrating an example of switching between ON and OFF states by a control circuit according to a first modification.
Figure 11:
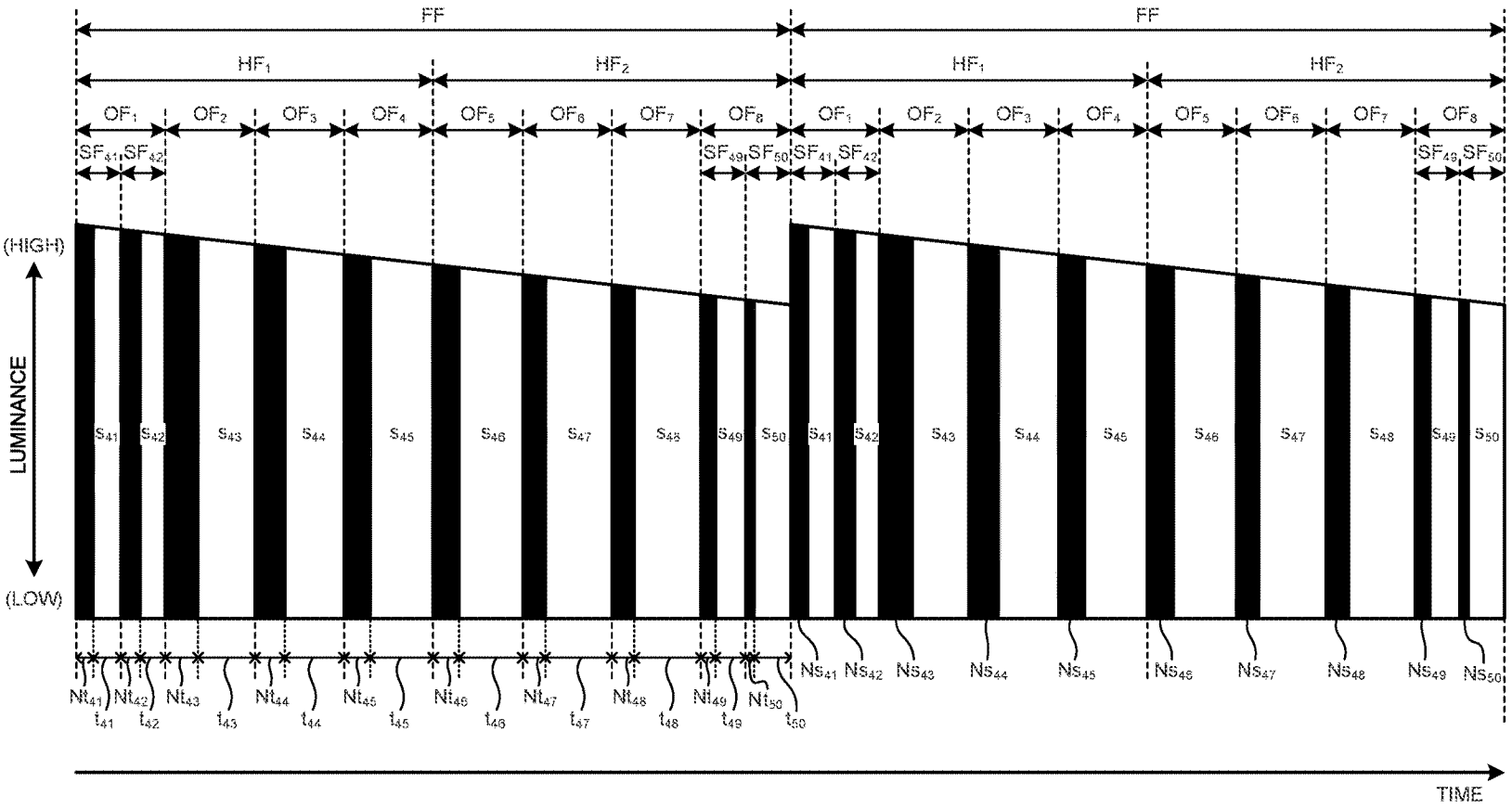
FIG. 11 is a diagram illustrating an example of switching between ON and OFF states by a control circuit according to a second modification.

In FIG. 8, and FIG. 10 and FIG. 11, which are to be described later, (hereinafter referred to as the diagrams such as FIG. 8), the light emission time slots are each indicated by "t" having a number attached thereto as a lower suffix, and the no-light emission time slots are each indicated by "Nt" having a number attached thereto as a lower suffix. In the diagrams such as FIG. 8, the light quantities of one of the organic light emitting diodes EL during the respective light emission time slots are each indicated by "s" having a number attached thereto as a lower suffix, and decreases of the light quantities of one of the organic light emitting diodes EL during the respective no-light emission time slots are each indicated by "Ns" having a number attached thereto as a lower suffix. Each of the diagrams such as FIG. 8 differently illustrates a one-frame period FF described with "Nt" indicating each no-light emission time slot, and another one-frame period FF described with "Ns" indicating a decrease of the light quantity of one of the organic light emitting diodes EL during the respective no-light emission time slots. These one-frame periods FF are deliberately illustrated differently for the sake of clearer presentation, and, actually, a decrease of the light quantity of the organic light emitting diode EL due to the no-light emission time slot "Nt" having a certain number attached thereto is "Ns" having the same number attached thereto, and "Nt" and "Ns" here correspond to each other. For example, the decreases $Ns_1$, $Ns_2$, $Ns_3$, $Ns_4$, $Ns_5$, $Ns_6$, $Ns_7$, $Ns_8$, $Ns_9$, $Ns_{10}$, $Ns_{11}$, $Ns_{12}$, $Ns_{13}$, $Ns_{14}$, $Ns_{15}$, and $Ns_{16}$ of the light quantities of the organic light emitting diode EL in FIG. 8 are the same as those of the light quantities due to the no-light emission time slots $Nt_1$, $Nt_2$, $Nt_3$, $Nt_4$, $Nt_5$, $Nt_6$, $Nt_7$, $Nt_8$, $Nt_9$, $Nt_{10}$, $Nt_{11}$, $Nt_{12}$, $Nt_{13}$, $Nt_{14}$, $Nt_{15}$, and $Nt_{16}$. Although not particularly mentioned herein, the same applies to FIG. 10 and FIG. 11. In the diagrams such as FIG. 8 and in FIG. 9, the vertical-axis direction indicates the level of luminance of the organic light emitting diode EL, and the horizontal-axis direction indicates elapsed time.

In this embodiment, the light emission time slots within any one of the unit time segments are of equal length of time, and the no-light emission time slots within any one of the unit time segments are of equal length of time. Specifically, one of the unit time segments, the unit time segment $OF_1$, in FIG. 8 can be described as follows. The unit time segment $OF_1$ is further equally divided into two sub-unit time segments $SF_1$ and $SF_2$. It is assumed that the relation between the unit time segment and the sub-unit time segments may be expressed, using the reference signs, as $OF_1=(SF_1, SF_2)$ for example. In the sub-unit time segment $SF_1$, the no-light emission time slot $Nt_1$ and the light emission time slot $t_1$ are set up. In the sub-unit time segment $SF_2$, the no-light emission time slot $Nt_2$ and the light emission time slot $t_2$ are set up. The no-light emission time slot $Nt_1$ and the no-light emission time slot $Nt_2$ are of equal length of time. The light emission time slot $t_1$ and the light emission time slot $t_2$ are of equal length of time. That is, an equation $Nt_1=Nt_2$ using the reference numerals holds. Another equation $t_1=t_2$ also holds. The light quantity of the organic light emitting diode EL during the unit time segment $OF_1$ is a light quantity obtained by adding together the light quantity $s_1$ and the light quantity $s_2$, and can be expressed as $s_1+s_2$ using the reference signs.

Another one of the unit time segments in FIG. 8, the unit time segment $OF_2$, immediately following the unit time segment $OF_1$ can be described as follows. The unit time segment $OF_2$ is further equally divided into two sub-unit time segments $SF_3$ and $SF_4$. That is, $OF_2=(SF_3, SF_4)$. In the sub-unit time segment $SF_3$, the no-light emission time slot $Nt_3$ and the light emission time slot $t_3$ are set up. In the sub-unit time segment $SF_4$, the no-light emission time slot $Nt_4$ and the light emission time slot $t_4$ are set up. The no-light emission time slot $Nt_3$ and the no-light emission time slot $Nt_4$ are of equal length of time. The light emission time slot $t_3$ and the light emission time slot $t_4$ are of equal length of time. That is, $Nt_3=Nt_4$ and $t_3=t_4$ hold. The light quantity of the organic light emitting diode EL during the unit time segment $OF_2$ is a light quantity obtained by adding together the light quantity $s_3$ and the light quantity $s_4$, that is, can be expressed as $s_3+s_4$. The control circuit 34 controls light emission of the organic light emitting diode EL in a manner such that a light quantity per each of the unit time segments is equalized. That is, the relation among the light quantities can be expressed as $(s_1+s_2)=(s_3+s_4)$.

While the description has been given using the two unit time segments $OF_1$ and $OF_2$ in FIG. 8 as examples, the same applies to the other unit time segments $OF_3$, $OF_4$, $OF_5$, $OF_6$, $OF_7$, and $OF_8$ within the one-frame period FF. That is, $OF_3=(SF_5, SF_6)$, $OF_4=(SF_7, SF_8)$, $OF_5=(SF_9, SF_{10})$, $OF_6=(SF_{11}, SF_{12})$, $OF_7=(SF_{13}, SF_{14})$, and $OF_8=(SF_{15}, SF_{16})$. Equations $Nt_5=Nt_6$, $Nt_7=Nt_8$, $Nt_9=Nt_{10}$, $Nt_{11}=Nt_{12}$, $Nt_{13}=Nt_{14}$, and $Nt_{15}=Nt_{16}$ hold. Equations $t_5=t_6$, $t_7=t_8$, $t_9=t_{10}$, $t_{11}=t_{12}$, $t_{13}=t_{14}$, and $t_{15}=t_{16}$ also hold. Equations $(s_1+s_2)=(s_3+s_4)=(s_5+s_6)=(s_7+s_8)=(s_9+s_{10})=(s_{11}+s_{12})=(s_{13}+s_{14})=(s_{15}+s_{16})$ also hold.

More specifically, in the example illustrated in FIG. 8, the control circuit 34 renders the non-light emission time slot shorter and the light emission time slot longer in a later one of the unit time segments than those in an earlier one thereof within the one-frame period FF on the following grounds: after a frame image is updated, the luminance of the organic light emitting diode EL decreases over time until the next frame image is updated. A condition $Nt_1=Nt_2>Nt_3=Nt_4>Nt_5=Nt_6>Nt_7=Nt_8>Nt_9=Nt_{10}>Nt_{11}=Nt_{12}>Nt_{13}=Nt_{14}>Nt_{15}=Nt_{16}$ using the reference signs holds. Another condition $t_1=t_2<t_3=t_4<t_5=t_6<t_7=t_8<t_9=t_{10}<t_{11}=t_{12}<t_{13}=t_{14}<t_{15}=t_{16}$ also hold.

As illustrated in FIG. 8, the respective light quantities of the organic light emitting diode EL during the respective eight unit time segments $OF_1$, $OF_2$, $OF_3$, $OF_4$, $OF_5$, $OF_6$, $OF_7$, and $OF_8$ are equal. Therefore, light quantities of the organic light emitting diode EL during the half-frame period $HF_1$ that includes the four unit time segments $OF_1$, $OF_2$, $OF_3$, and $OF_4$ and during the half-frame period $HF_2$ that includes the four unit time segments $OF_5$, $OF_6$, $OF_7$, and $OF_8$ are also equal. That is, each of the two half-frame periods $HF_1$ and $HF_2$ may be treated as the certain unit time segment. The specifics illustrated hereinabove such as the number of certain unit time segments within each of the one-frame periods FF and the number of sub-unit time segments within each of the unit time segments are merely specific examples, and can be changed as appropriate.

Thus, the control circuit 34 is capable of equalizing a light quantity per each of the unit time segments by controlling the duty cycles of the light emission period and the non-light emission period of the organic light emitting diode EL to the one-frame period FF.

In this embodiment, each of the one-frame period FF corresponds to a time period for which one frame image is displayed, for example at a refresh rate of 30 Hz. Each of the half-frame period $HF_1$ and $HF_2$ corresponds to a time period for which one frame image is displayed at a refresh rate of 60 Hz. Each of the unit time segments $OF_1$, . . . , and $OF_8$ corresponds to a time period for which one frame image is displayed at a refresh rate of 240 Hz. Each of the sub-unit time segments $SF_1$, . . . , and $SF_{16}$ corresponds to a time period for which one frame image is displayed at a refresh rate of 480 Hz. The specific time periods for these periods are illustrative only and not limiting, and can be changed as appropriate.

As described above, according to this embodiment, a time period during which a frame image is being displayed is divided into certain unit time segments (for example, eight unit time segments $OF_1$, $OF_2$, $OF_3$, $OF_4$, $OF_5$, $OF_6$, $OF_7$, and $OF_8$), and light emission of the sub-pixel 49 is switched on and off in a manner such that a light quantity per each of the unit time segments can be equalized. The light quantity per each of the unit time segments is thus equalized over a period immediately before and after update of a frame image, so that the sub-pixels 49 appear as if continuously emitting light at the same light quantity. This embodiment therefore can prevent flickers from occurring over a period from before to after the update.

A plurality of light emission time slots, during each of which the sub-pixel 49 continues emitting light, and a plurality of no-light emission time slots, during each of which the sub-pixel 49 does not emit light, are set up within the respective unit time segments. The light emission time slots and the no-light emission time slots thus can be more dispersed than otherwise across a time span (one-frame period FF) in which one frame image is displayed. This can reduce the difference in luminance between the two light emission time slots that are adjacent with one of the no-light emission time slots therebetween.

The light emission time slots within one unit time segment are of equal length of time, and the no-light emission time slots within one unit time are of equal length of time. This makes it easier to simplify control of the light emission within each unit time segment, which is performed by the control circuit 34 on the sub-pixel 49. That is, the lengths of time for the light emission time slots and the lengths of time for the no-light emission time slots are simply repeated without being changed within each unit time segment, which allows simplification of instructions.

Modifications

The following describes modifications of the embodiment according to the present invention. In describing the modifications, the same reference signs are assigned to the same components as those in the embodiment, and descriptions thereof may be omitted. The specific configurations of the modifications are the same as those of the embodiment except for points mentioned below in particular.

First Modification

FIG. 10 is a diagram illustrating an example of switching between ON and OFF states by the control circuit 34 according to a first modification. The control circuit 34 in the first modification switches light emission of a pixel (for example, the sub-pixels 49 included in the pixel 48) on and off more frequently in the unit time segment immediately following update of a frame image than in each of the other unit time segments.

Specifically, in the first modification, the unit time segment $OF_1$ includes two sub-unit time segments $MF_1$ and $MF_2$, and the unit time segment $OF_2$ includes two sub-unit time segments $MF_3$ and $MF_4$, as illustrated in FIG. 10. Each of the sub-unit time segments $OF_3$, $OF_4$, $OF_5$, $OF_6$, $OF_7$, and $OF_8$ does not include sub-unit time segments. In the first modification, one light emission time slot and one no-light emission time slot are set up in each of the sub-unit time segments $MF_1$, $MF_2$, $MF_3$, and $MF_4$. That is, light emission time slots $t_{21}$, $t_{22}$, $t_{23}$, and $t_{24}$ and no-light emission time slots $Nt_{21}$, $Nt_{22}$, $Nt_{23}$, and $Nt_{24}$ are set up within a period composed of the unit time segments $OF_1$ and $OF_2$ that includes the sub-unit time segments $MF_1$, $MF_2$, $MF_3$, and $MF_4$. In the first modification, the control circuit 34 switches light emission of the sub-pixel 49 in a manner such that light quantities during the respective sub-unit time segments $MF_1$, $MF_2$, $MF_3$, and $MF_4$ can be equalized. That is, light quantities $s_{21}$, $s_{22}$, $s_{23}$, and $s_{24}$ corresponding to the respective light emission time slots $t_{21}$, $t_{22}$, $t_{23}$, and $t_{24}$ in the respective sub-unit time segments $MF_1$, $MF_2$, $MF_3$, and $MF_4$ are equal. That is, $s_{21}=s_{22}=s_{23}=s_{24}$ holds. The lengths of the sub-unit time segment $MF_1$, $MF_2$, $MF_3$, and $MF_4$ are equal. Conditions $t_{21}<t_{22}<t_{23}<t_{24}$ and $Nt_{21}>Nt_{22}>Nt_{23}>Nt_{24}$ also hold.

In the first modification, one light emission time slot and one no-light emission time slot are set up in each of the unit time segments $OF_3$, $OF_4$, $OF_5$, $OF_6$, $OF_7$, and $OF_8$. That is, the light emission time slots $t_{25}$, $t_{26}$, $t_{27}$, $t_{28}$, $t_{29}$, and $t_{30}$, and the no-light emission time slots $Nt_{25}$, $Nt_{26}$, $Nt_{27}$, $Nt_{28}$, $Nt_{29}$, and $Nt_{30}$ are set up within a period composed of the unit time segments $OF_3$, $OF_4$, $OF_5$, $OF_6$, $OF_7$, and $OF_8$. Light quantities of the organic light emitting diode EL corresponding to the respective light emission time slots $t_{25}$, $t_{26}$, $t_{27}$, $t_{28}$, $t_{29}$, and $t_{30}$ are light quantities $s_{25}$, $s_{26}$, $s_{27}$, $s_{28}$, $s_{29}$, and $s_{30}$.

In the first modification, as with the case of the embodiment, the control circuit 34 switches light emission of the sub-pixel 49 on and off in a manner such that light quantities during the respective unit time segments $OF_1$, $OF_2$, $OF_3$, $OF_4$, $OF_5$, $OF_6$, $OF_7$, and $OF_8$ are equalized. That is, the light quantity $(s_{21}+s_{22})$ obtained by adding together the light quantity $s_{21}$ and the light quantity $s_{22}$, the light quantity $(s_{23}+s_{24})$ obtained by adding together the light quantity $s_{23}$ and the light quantity $s_{24}$, the light quantity $s_{25}$, the light quantity $s_{26}$, the light quantity $s_{27}$, the light quantity $s_{28}$, the light quantity $s_{29}$, and the light quantity $s_{30}$ are equal. That is, $(s_{21}+s_{22})=(s_{23}+s_{24})=s_{25}=s_{26}=s_{27}=s_{28}=s_{29}=s_{30}$ holds. Conditions $t_{25}<t_{26}<t_{27}<t_{28}<t_{29}<t_{30}$ and $Nt_{25}>Nt_{26}>Nt_{27}>Nt_{28}>Nt_{29}>Nt_{30}$ also hold.

In the first modification, the light quantities during the respective unit time segments $OF_1$, $OF_2$, $OF_3$, $OF_4$, $OF_5$, $OF_6$, $OF_7$, and $OF_8$ are equal. Therefore, when light quantities in units of certain time periods each including two of the unit time segments are considered, light quantities during the respective certain time periods are equal. That is, $(s_{21}+s_{22})+(s_{23}+s_{24})=s_{25}+s_{26}=s_{27}+s_{28}=s_{29}+s_{30}$ holds. In the first modification, as described above, only one of the certain time periods that includes the unit time segments $OF_1$ and $OF_2$ includes: the sub-unit time segments $MF_1$, $MF_2$, $MF_3$, and $MF_4$; the four light emission time slots $t_{21}$, $t_{22}$, $t_{23}$, and $t_{24}$; and the four no-light emission time slots $Nt_{21}$, $Nt_{22}$, $Nt_{23}$, and $Nt_{24}$. The certain time period that includes the unit time segments $OF_3$ and $OF_4$ includes: the two light emission time slots $t_{25}$ and $t_{26}$; and two no-light emission time slots $Nt_{25}$ and $Nt_{26}$. The certain time period that includes the unit time segments $OF_5$ and $OF_6$ includes: the two light emission time slots $t_{27}$ and $t_{28}$; and two no-light emission time slots $Nt_{27}$ and $Nt_{28}$. The certain time period that includes the unit time segments $OF_7$ and $OF_8$ includes: the two light emission time slots $t_{29}$ and $t_{30}$; and two no-light emission time slots $Nt_{29}$ and $Nt_{30}$. Thus, in the first modification, light emission of the sub-pixel 49 is switched on and off more frequently in the certain time period that includes the unit time segments $OF_1$ and $OF_2$ than in the other certain time periods. In other words, in the first modification, the control circuit 34 sets the two unit time segments $OF_1$ and $OF_2$ in the embodiment as one unit time segment, and switches light emission of the sub-pixel 49 on and off more frequently in the unit time segment immediately following update of a frame image than in the other unit time segments.

As described above, according to the first modification, the light emission time slots and the no-light emission time slots that immediately follow update of a frame image, which fall within a period when flickers are likely to be visually recognized, are more scattered than in the other period. This scattering can prevent flickers from being visibly present that would otherwise be visibly present if light emission time slots with relatively high luminance were continuous. Switching from one slot to the next among the light emission time slots and the no-light emission time slots is made less frequent in the unit time segments, other than the one immediately following update of a frame image, than the one immediately following the update. Thus, the processing load and the power consumption of the control circuit 34 can be reduced.

Second Modification

FIG. 11 is a diagram illustrating an example of switching between ON and OFF states by the control circuit 34 according to a second modification. The control circuit 34 in the second modification switches light emission of a pixel (for example, the sub-pixels 49 included in the pixel 48) on and off more frequently in each of the unit time segments immediately preceding and following update of a frame image than in each of the other unit time segments.

Specifically, in the second modification, the unit time segment $OF_1$ includes two sub-unit time segments $SF_{41}$ and $SF_{42}$, and the unit time segment $OF_8$ includes two sub-unit time segments $SF_{49}$ and $SF_{50}$, as illustrated in FIG. 11. Each of the unit time segments $OF_2$, $OF_3$, $OF_4$, $OF_5$, $OF_6$, and $OF_7$ does not include sub-unit time segments. In the second modification, one light emission time slot and one no-light emission time slot are set up in each of the sub-unit time segments $SF_{41}$, $SF_{42}$, $SF_{49}$, and $SF_{50}$. That is, light emission time slots $t_{41}$, $t_{42}$, $t_{49}$, and $t_{50}$ and no-light emission time slots $Nt_{41}$, $Nt_{42}$, $Nt_{49}$, and $Nt_{50}$ are set up within a period composed of the unit time segments $OF_1$ and $OF_8$ immediately following and preceding update of each frame image, the period including the sub-unit time segments $SF_{41}$, $SF_{42}$, $SF_{49}$, and $SF_{50}$. Thus, in the second modification, the control circuit 34 switches light emission of the sub-pixel 49 on and off more frequently during the unit time segments $OF_1$ and $OF_8$ immediately following and immediately preceding update of each frame image than in the other unit time segments $OF_2$, $OF_3$, $OF_4$, $OF_5$, $OF_6$, and $OF_7$.

In the second modification, the control circuit 34 switches light emission of the sub-pixel 49 in a manner such that light quantities during the respective sub-unit time segments $SF_{41}$, $SF_{42}$, $SF_{49}$, and $SF_{50}$ are equalized. That is, light quantities $s_{41}$, $s_{42}$, $s_{49}$, and $s_{50}$ corresponding to the respective light emission time slots $t_{41}$, $t_{42}$, $t_{49}$, and $t_{50}$ in the respective sub-unit time segments $SF_{41}$, $SF_{42}$, $SF_{49}$, and $SF_{50}$ are equal. That is, $s_{41}=s_{42}=s_{49}=s_{50}$ holds. The lengths of the sub-unit time segment $SF_{41}$, $SF_{42}$, $SF_{49}$, and $SF_{50}$ are equal. Conditions $t_{41}<t_{42}<t_{49}<t_{50}$ and $Nt_{41}>Nt_{42}>Nt_{49}>Nt_{50}$ also hold.

In the second modification, one light emission time slot and one no-light emission time slot are set up in each of the unit time segments $OF_2$, $OF_3$, $OF_4$, $OF_5$, $OF_6$, and $OF_7$. That is, the light emission time slots $t_{43}$, $t_{44}$, $t_{45}$, $t_{46}$, $t_{47}$, and $t_{48}$, and the no-light emission time slots $Nt_{43}$, $Nt_{44}$, $Nt_{45}$, $Nt_{46}$, $Nt_{47}$, and $Nt_{48}$ are set up within a period corresponding to the unit time segments $OF_2$, $OF_3$, $OF_4$, $OF_5$, $OF_6$, and $OF_7$. Light quantities from the organic light emitting diode EL that correspond to the respective light emission time slots $t_{43}$, $t_{44}$, $t_{45}$, $t_{46}$, $t_{47}$, and $t_{48}$ are light quantities $s_{43}$, $s_{44}$, $s_{45}$, $s_{46}$, $s_{47}$, and $s_{48}$.

In the second modification, as with the case of the embodiment, the control circuit 34 switches light emission of the sub-pixel 49 on and off in a manner such that light quantities during the respective unit time segments $OF_1$, $OF_2$, $OF_3$, $OF_4$, $OF_5$, $OF_6$, $OF_7$, and $OF_8$ are equalized. That is, the light quantity $(s_{41}+s_{42})$ obtained by adding together the light quantity $s_{41}$ and the light quantity $s_{42}$, the light quantity $s_{43}$, the light quantity $s_{44}$, the light quantity $s_{45}$, the light quantity $s_{46}$, the light quantity $s_{47}$, the light quantity $s_{48}$, and the light quantity $(s_{49}+s_{50})$ obtained by adding together the light quantity $s_{49}$ and the light quantity $s_{50}$ are equal. That is, $(s_{41}+s_{42})=s_{43}=s_{44}=s_{45}=s_{46}=s_{47}=s_{48}=(s_{49}+s_{50})$ holds. Conditions $t_{43}<t_{44}<t_{45}<t_{46}<t_{47}<t_{48}$ and $Nt_{43}>Nt_{44}>Nt_{45}>Nt_{46}>Nt_{47}>Nt_{48}$ also hold.

As described above, according to the second modification, the light emission time slots and the no-light emission time slots in the unit time segments that immediately precede and immediately follow update of each frame image, in which flickers are likely to be visually recognized, are more scattered than those in the other period. This scattering can more reliably preclude visible presence of flickers that would otherwise be visibly present because of the continuity between a light emission time slot with relatively low luminance and a light emission time slot with relatively high luminance. Switching from one slot to the next among the light emission time slots and the no-light emission time slot is made less frequent in the unit time segments other than those immediately preceding and immediately following update of each frame image. Thus, the processing load and the power consumption of the control circuit 34 can be reduced.

Each of the embodiment and the modifications (hereinafter referred to as the embodiment and the like) includes the light emission control transistor CCT and controls the operation thereof to control timings when the organic light emitting diode EL emits light. Each of the embodiment and the like is, however, merely a specific configuration example for light emission timing control over the organic light emitting diode EL, and not limiting. For example, the operation of the light emission control transistor CCT in each of the embodiment and the like may be included as a part of the operation of the EL power-supply opening/closing transistor BCT so that the EL power-supply opening/closing transistor BCT may concurrently serve as the light emission control transistor CCT.

While the no-light emission time slot is followed by the light emission time slot in each of the certain unit time segments in each of the embodiment and the like, the light emission time slot may be followed by the no-light emission time slot.

In addition, the configuration of the controller corresponding to the control circuit 34 is not limited to one configuration included in the image display panel driving device 30. The controller may be, for example, a circuit provided independently from the image display panel driving device 30.

It should be understood that other functions and effects that would be brought about by aspects described in the embodiment and the like and that are obvious from the description of this specification or are conceivable by the skilled person in the art are naturally included in the present invention.

What is claimed is:

1. A display apparatus comprising:

a display device including a plurality of pixels; and a controller configured to control light emission timing of each of the pixels, wherein each of the pixels including:

a drive transistor having a first side and a second side, wherein the first side is a source and the second side is a drain, or the first side is the drain and the second side is the source;

a light emitting element having an anode side and a cathode side, wherein the anode side is coupled to the first side of the drive transistor, and the cathode side is coupled to a reference potential;

an EL-power-supply switch, wherein the second side of the drive transistor is coupled to a power source through the EL-power-supply switch; and a storing capacitor having one end coupled to a gate of the drive transistor and another end coupled to the source of the drive transistor, a current from the drive transistor to the light emitting element is determined based on a voltage between the gate and the source of the drive transistor according to electric charge stored in the storing capacitor, and the controller is configured to divide a one-frame period during which a frame image is being displayed into certain unit time segments each having a same time period and each including one or more light emission time slots during each of which the pixel is emitting light and one or more no-light emission time slots during each of which the pixel is not emitting light, and then configured to switch light emission of the pixel on and off in a manner such that a light quantity in the one or more light emission time slots per each of the unit time segment is equalized.

2. The display apparatus according to claim 1, wherein the one-frame period has a first half-frame period and a second half-frame period that follows the first half-frame period, each of the first half-frame period and the second half-frame period includes discontinuous light emission time slots and discontinuous no-light emission slots, the first half-frame period includes:

one or more first unit time segments each including a first count of the light emission time slots and the first count of the no-light emission slots; and a plurality of second unit time segments each including a second count of the light emission time slots and the second count of the no-light emission slots, the first count being greater than the second count, and the controller is configured to switch light emission of the pixel on and off more frequently in the first unit time segments which includes a starting unit time segment that immediately follows update of the frame image, than in the second unit time segment in the first half-frame period.

3. The display apparatus according to claim 2, wherein the second half-frame period includes:

the second unit time segments each including the second count of the light emission time slots and the second count of the no-light emission slots; and one or more third unit time segments each including a third count of the light emission time slots and the third count of the no-light emission slots, the third count being greater than the second count, and the controller is configured to switch light emission of the pixel on and off more frequently in the third unit time segments, which includes a last unit time segment that that immediately precedes update of the frame image, than in the second unit time segments in the second half-frame period.

4. The display apparatus according to claim 3, wherein a continuous decrease in electric charge in the storing capacitor results in a decrease in luminance of the light emitting element within the one-frame period.

5. The display apparatus according to claim 3, wherein the EL-power-supply switch is Off during each of the one or more non-light emission time slots and ON during each of the one or more light emission time slots.

6. The display apparatus according to claim 2, wherein a continuous decrease in electric charge in the storing capacitor results in a decrease in luminance of the light emitting element within the one-frame period.

7. The display apparatus according to claim 2, wherein the EL-power-supply switch is Off during each of the one or more non-light emission time slots and ON during each of the one or more light emission time slots.

8. The display apparatus according to claim 2, wherein a count of the one or more light emission time slots in the first half-frame period is greater than a count of the one or more light emission time slots in the second half-frame period, and a count of the one or more no-light emission slots in the first half-frame period is greater than a count of the one or more no-light emission slots in the second half-frame period.

9. The display apparatus according to claim 1, wherein the one or more light emission time slots are a plurality of light emission time slots, the one or more no-light emission time slots are a plurality of no-light emission slots, the light emission time slots within any one of the unit time segments are of substantially equal length of time, and the no-light emission time slots within any one of the unit time segments are of substantially equal length of time.

10. The display apparatus according to claim 9, wherein the EL-power-supply switch is Off during each of the one or more non-light emission time slots and ON during each of the one or more light emission time slots.

11. The display apparatus according to claim 1, wherein a continuous decrease in electric charge in the storing capacitor results in a decrease in luminance of the light emitting element within the one-frame period.

12. The display apparatus according to claim 1, wherein the EL-power-supply switch is Off during each of the one or more non-light emission time slots and ON during each of the one or more light emission time slots.

13. A display apparatus comprising:

a display device including a plurality of pixels; and a controller configured to control light emission timing of each of the pixels, wherein each of the pixels including:

a drive transistor;

a light emitting element coupled to a source terminal of the drive transistor and to a reference potential; and a storing capacitor having one end coupled to a gate of the drive transistor and another end coupled to the source of the drive transistor, a current from the drive transistor to the light emitting element is determined based on a voltage between the gate and the source of the drive transistor according to electric charge stored in the storing capacitor, and the controller is configured to divide a one-frame period during which a frame image is being displayed into certain unit time segments each having a same time period and each including one or more light emission time slots during each of which the pixel is emitting light and one or more no-light emission time slots during each of which the pixel is not emitting light, and then configured to switch light emission of the pixel on and off in a manner such that a light quantity in the one or more light emission time slots per each of the unit time segment is equalized.

14. A display apparatus comprising:

a display device including a plurality of pixels including: a drive transistor;

a light emitting element coupled to a source terminal of the drive transistor and to a reference potential; and a storing capacitor having one end coupled to a gate of the drive transistor and another end coupled to the source of the drive transistor, wherein a current from the drive transistor to the light emitting element is determined based on a voltage between the gate and the source of the drive transistor according to electric charge stored in the storing capacitor, and the display device is configured to divide a one-frame period during which a frame image is being displayed into certain unit time segments each having a same time period and each including one or more light emission time slots during each of which the pixel is emitting light and one or more no-light emission time slots during each of which the pixel is not emitting light, and then configured to switch light emission of the pixel on and off in a manner such that a light quantity in the one or more light emission time slots per each of the unit time segment is equalized.

* * * * *